US007431171B2

(12) United States Patent
Lamarche

(10) Patent No.: US 7,431,171 B2
(45) Date of Patent: Oct. 7, 2008

(54) TWO PIECE CONTAINER INCORPORATING NESTING CHARACTERISTICS AND INCLUDING INTERENGAGEABLE HINGE SUPPORTS FOR UPWARDLY SUPPORTING A LID UPON A BASE

(76) Inventor: Paul Lamarche, 51550 Hayes Rd., Macomb, MI (US) 48042

( * ) Notice: Subject to any disclaimer, the term of this patent is extended or adjusted under 35 U.S.C. 154(b) by 0 days.

(21) Appl. No.: 11/530,764

(22) Filed: Sep. 11, 2006

(65) Prior Publication Data

US 2008/0073339 A1 Mar. 27, 2008

(51) Int. Cl.

| | |
|---|---|
| ***B65D 6/28*** | (2006.01) |
| ***B65D 51/04*** | (2006.01) |
| ***E05D 7/12*** | (2006.01) |
| *B65D 85/62* | (2006.01) |
| *B65D 21/02* | (2006.01) |

(52) U.S. Cl. ..... 220/4.21; 220/4.22; 220/840; 220/770; 220/771; 16/271; 206/508; 206/511

(58) Field of Classification Search ..... 220/4.21–4.23, 220/770, 771, 788, 784, 840, 324, 345.1, 220/345.2, 812, 345.4, 813, 841, 657, 752; 16/271, 268; 206/508, 511

See application file for complete search history.

(56) References Cited

U.S. PATENT DOCUMENTS

| | | | | | |
|---|---|---|---|---|---|
| 2,527,318 | A | * | 10/1950 | Magnus | 220/832 |
| 3,219,400 | A | * | 11/1965 | Bergquist | 312/107 |
| 3,285,464 | A | * | 11/1966 | Boydman | 220/837 |
| 3,351,270 | A | * | 11/1967 | Hohnjec | 220/835 |
| 4,401,312 | A | * | 8/1983 | Parker | 280/47.17 |
| 4,431,114 | A | * | 2/1984 | Kleinfeld | 220/835 |
| 4,832,198 | A | * | 5/1989 | Alikhan | 206/438 |
| 5,022,515 | A | | 6/1991 | Agostine | |
| 5,065,887 | A | * | 11/1991 | Schuh et al. | 220/835 |
| 5,074,410 | A | | 12/1991 | Fries et al. | |
| 5,499,715 | A | * | 3/1996 | Nemeth | 206/505 |
| 5,775,508 | A | * | 7/1998 | Bongard et al. | 206/711 |
| 5,964,350 | A | | 10/1999 | LaMarche et al. | |
| 6,129,505 | A | | 10/2000 | Jupille et al. | |
| 6,237,772 | B1 | | 5/2001 | LaMarche et al. | |

* cited by examiner

*Primary Examiner*—Robin Hylton
(74) *Attorney, Agent, or Firm*—Gifford, Krass, Sprinkle, Anderson & Citowski, P.C.

(57) ABSTRACT

A two piece storage container including a lid having a rectangular shape with sides and ends defining therebetween a recessed interior, the lid including a plurality of spaced apart lips extending from a selected end. A base corresponding generally in outline with the lid and including an equal plurality of upwardly projecting hinge supports which are located proximate to an associated end of the base arrayed in opposing and communicable fashion relative to the lips upon positioning of the lid over the base. The lips are angularly supported within said hinge supports in a first open rotated position and, upon being rotated to a closed position, capable of being linearly displaced against said hinge supports to lock said lid to said base.

17 Claims, 5 Drawing Sheets

12
22
88
42
50
10
100
32
16
36
102
104
44
52
30
40
54
46
70
96
20
56
18
24
72
26
28
48
38
74
16
14

22
88
42
114
12
100
104
102
32
36
52
96
18
90
20
50
54
10
40
56
38
112
30
24
110
44
98
46
34
48
106
108
70

72
26
14
28
74

Fig-3
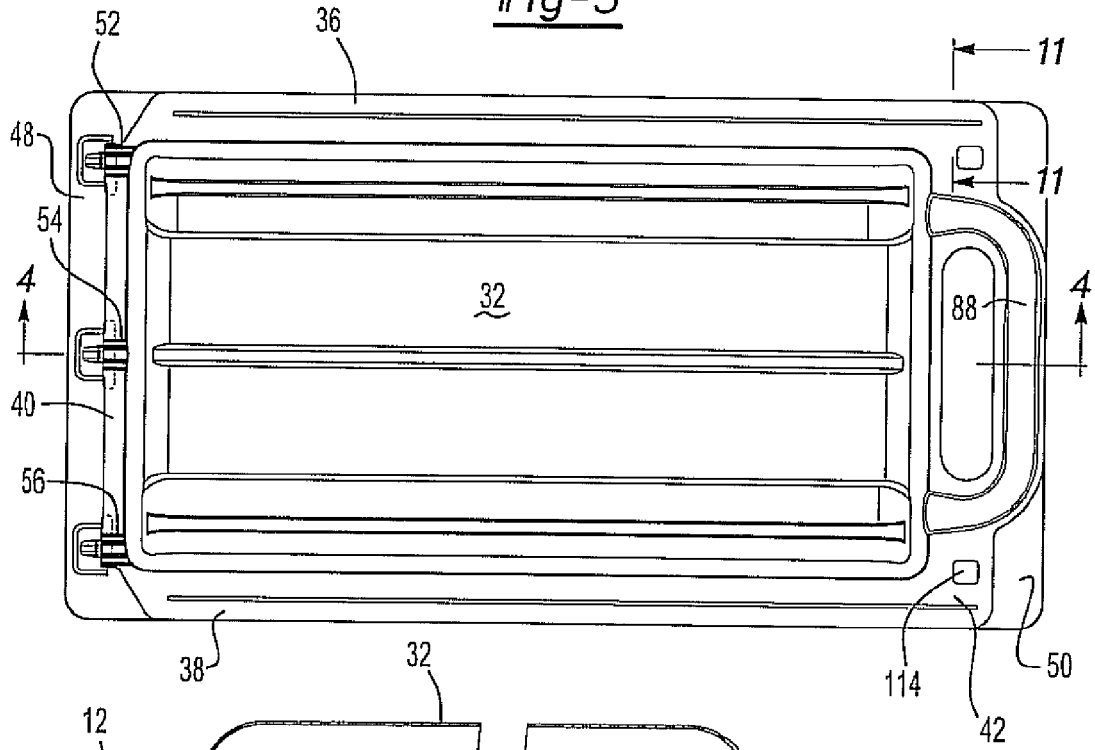
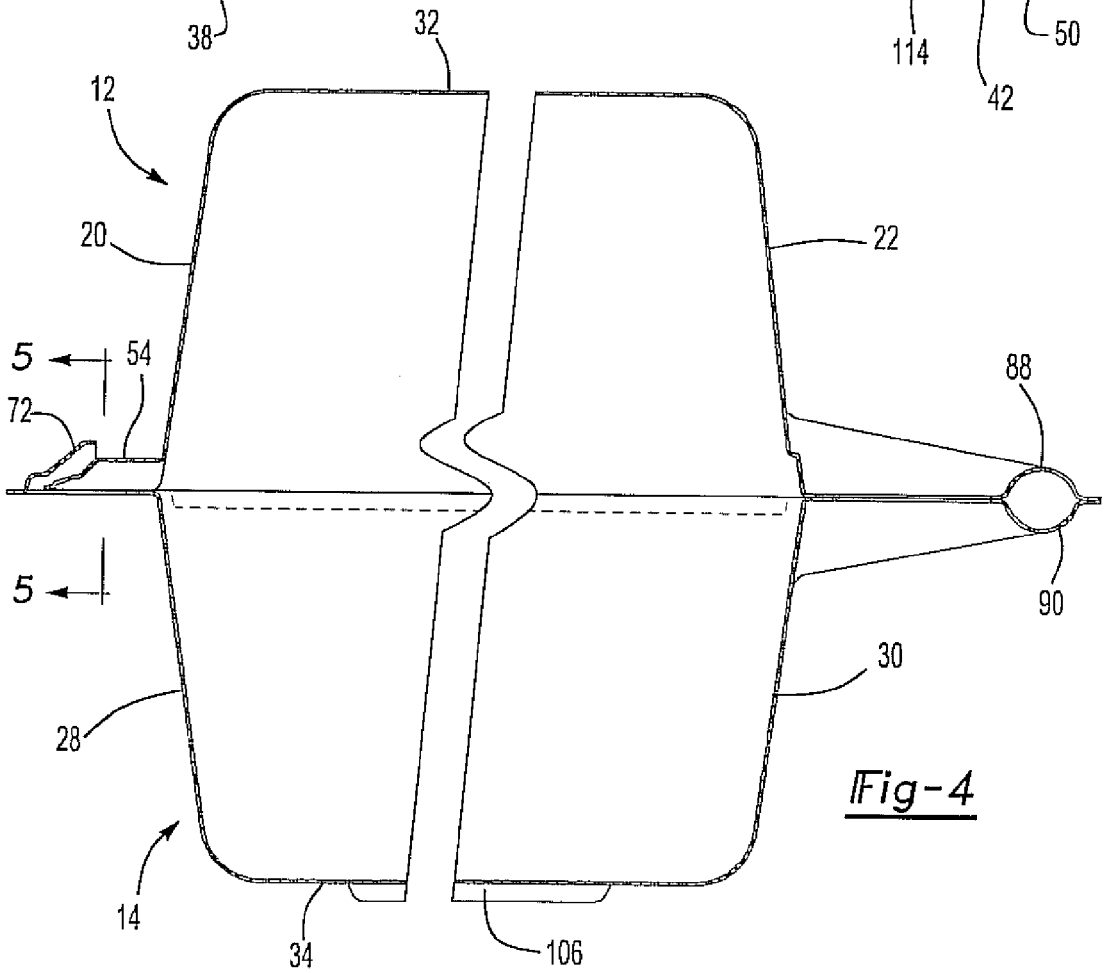
Fig-4

TWO PIECE CONTAINER INCORPORATING NESTING CHARACTERISTICS AND INCLUDING INTERENGAGEABLE HINGE SUPPORTS FOR UPWARDLY SUPPORTING A LID UPON A BASE

BACKGROUND OF THE INVENTION

1. Field of the Invention

The present invention relates generally to what is conventionally known as a hat box design. More specifically, the present invention discloses a two piece plasticized container with a lid and a base and which incorporates a novel interlocking arrangement established therebetween to permit the lid to be angularly supported upon the base in a first open configuration and, upon being rotated to a closed position, linearly displaced forwardly to establish a tactile and snap-shut configuration.

2. Description of the Prior Art

The prior art is well documented with examples of either hat box or other article holding/supporting containers. In one application, it is desirable to be able to interlock together in a stacking arrangement a plurality of item holdable containers.

A first example of such an assembly is set forth in U.S. Pat. No. 6,237,772 and U.S. Pat. No. 5,964,350, both issued to LaMarche et al., and which teach an assembly of interconnected containers, each exhibiting an upper portion permanently connected to a lower portion by a hinge or hinges, and with the upper portion having a pair of elongated generally parallel upwardly open channels. The container also has a pair of generally parallel downwardly projecting flanges structured to engage an upwardly open channel of an adjacent container and adjacent containers having either at least one of the channels engaged by a flange of an adjacent container or at least one of its flanges engaged in a channel of an adjacent container or both. The channels preferably communicate with at least one open end so as to permit relative sliding removal and insertion of the containers from and into the assembly. The channels are disposed closer to each other than are the flanges. In one embodiment, the upper portion has the upper sidewalls diverging downwardly therefrom and the lower wall has a pair of lower sidewalls diverging upwardly therefrom. The containers may be transparent and molded as a unit with integrally formed hinges. Support structure may be provided within the container to support one or more articles disposed therein. Individual containers for use in such an assembly are disclosed.

U.S. Pat. No. 6,129,505, issued to Jupille et al., teaches a plurality of stackable trays and methods for stacking the same. Each tray exhibits two side walls, each having a top channel along its top edge and a bottom channel along its bottom edge, each channel further having an inner and an outer channel wall, where the width of two adjacent top channel outer channel walls is less than the width of the bottom channel, whereby two such top channel walls may slide into a bottom channel of a stackable tray of like kind, and where the width of two adjacent bottom channel outer channel walls is less than the width of the top channel, whereby two such bottom channel walls may slide into a top channel of a stackable tray of like kind.

U.S. Pat. No. 5,074,410, issued to Fries et al., teaches a portable hat box for a brimmed hat having an upper member and a lower member. The upper member is pivotal relative to the lower member about a pivot axis and between closed and open positions. The members in the closed position completely enclose a hat chamber. Each of the members includes a platen surface. The lower member platen surface is substantially complementary in shape to the upper member platen surface. The platen surfaces are positioned adjacent to one another, having a substantially constant vertical clearance therebetween in the closed position, as well as being non-adjacent and obliquely related in the open position.

Finally, U.S. Pat. No. 5,022,515, issued to Agostine, teaches a hat storage container wherein outer walls define a body and a bill, enclosing a space including a main body chamber and a bill-shaped container adapted to receiving a hat bill. The main body chamber is adapted to receive the main body portion of one or more corresponding billed hats. Preferably, the main body chamber is longer than the main body portions of the hats to be stored therein, whereby the main body chamber is adapted to receive a shingled array of a plurality of the hats; the bill-receiving chamber being adapted to receive the corresponding shingled array of bills.

SUMMARY OF THE PRESENT INVENTION

The present invention discloses a two piece storage container, such as in particular for a hat box, and which is an improvement over other prior art designs in that it provides for improved locking and upwardly arrayed support of a first volume defining lid relative to an opposing and volume defining base. The lid exhibits a substantially rectangular shape, with interconnecting sides and ends defining therebetween a recessed interior and further includes a plurality of spaced apart lips extending from a selected end.

The base corresponds generally in outline with the lid and includes an equal plurality of upwardly projecting hinge supports, these being located proximate to an associated end of the base arrayed in opposing and communicable fashion relative to the lips, upon positioning of the lid over the base. The spaced apart lips are angularly supported within the hinge supports in a first open rotated position and, upon rotating the lid to a closed position, the lips are further linearly displacing in a direction against the hinge supports, in order to lock the lid to the base.

Additional features include each of the lid and base further including a handle subset portion associated with further selected edges opposite those associated with the lip and hinge support, the subset portions mating upon rotating the lid to the closed position to define a carrying handle. The lips are further each configured to include an angled ramp portion, and upon which is situated an integrally formed superstructure. The base defined hinge supports each further include upwardly extending primary and succeeding secondary embossments, these overlaying a perimeter defined aperture formed upon a flat edge location, in order to both support the lid in its upwardly angled position as well as to effectuate a tactile and "snap shut" feel upon rotating the lid to the closed position and sliding inwardly against the base.

BRIEF DESCRIPTION OF THE DRAWINGS

Reference will now be made to the attached drawings, when read in combination with the following detailed description, wherein like reference numerals refer to like parts throughout the several views, and in which:

FIG. 3 is a top plan view of the container design of FIG. 1;

FIG. 4 is a cutaway view taken along line 4-4 of FIG. 3 and showing the respective points of engagement established between a first handle supporting end and a second hinged end;

DETAILED DESCRIPTION OF THE PREFERRED EMBODIMENTS

Figure 1:
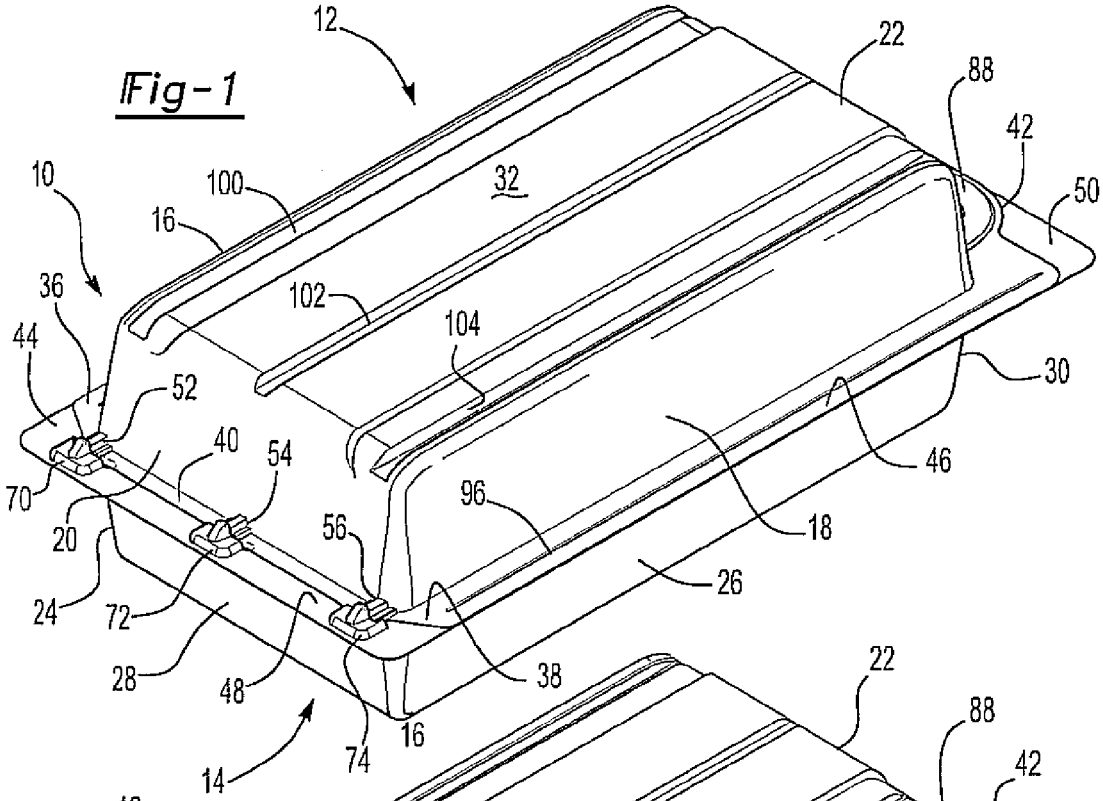
FIG. 1 is an assembled perspective view of the two piece container according to a preferred embodiment of the present invention.

Referring now to FIG. 1, an assembled perspective view is illustrated at 10 of a two piece container according to a preferred embodiment of the present invention. As previously described, the present invention discloses an improved item holding container assembly, typically a hat box configuration, and which in particular discloses an improved hinge construction (interlocking arrangement) established between a base and a separable lid, such that the lid is capable of being angularly supported upon the base in a first open configuration and, upon being rotated to a closed position, linearly displaced forwardly to establish a tactile and snap-shut configuration to permit the assembled item to be transported.

Figure 2:
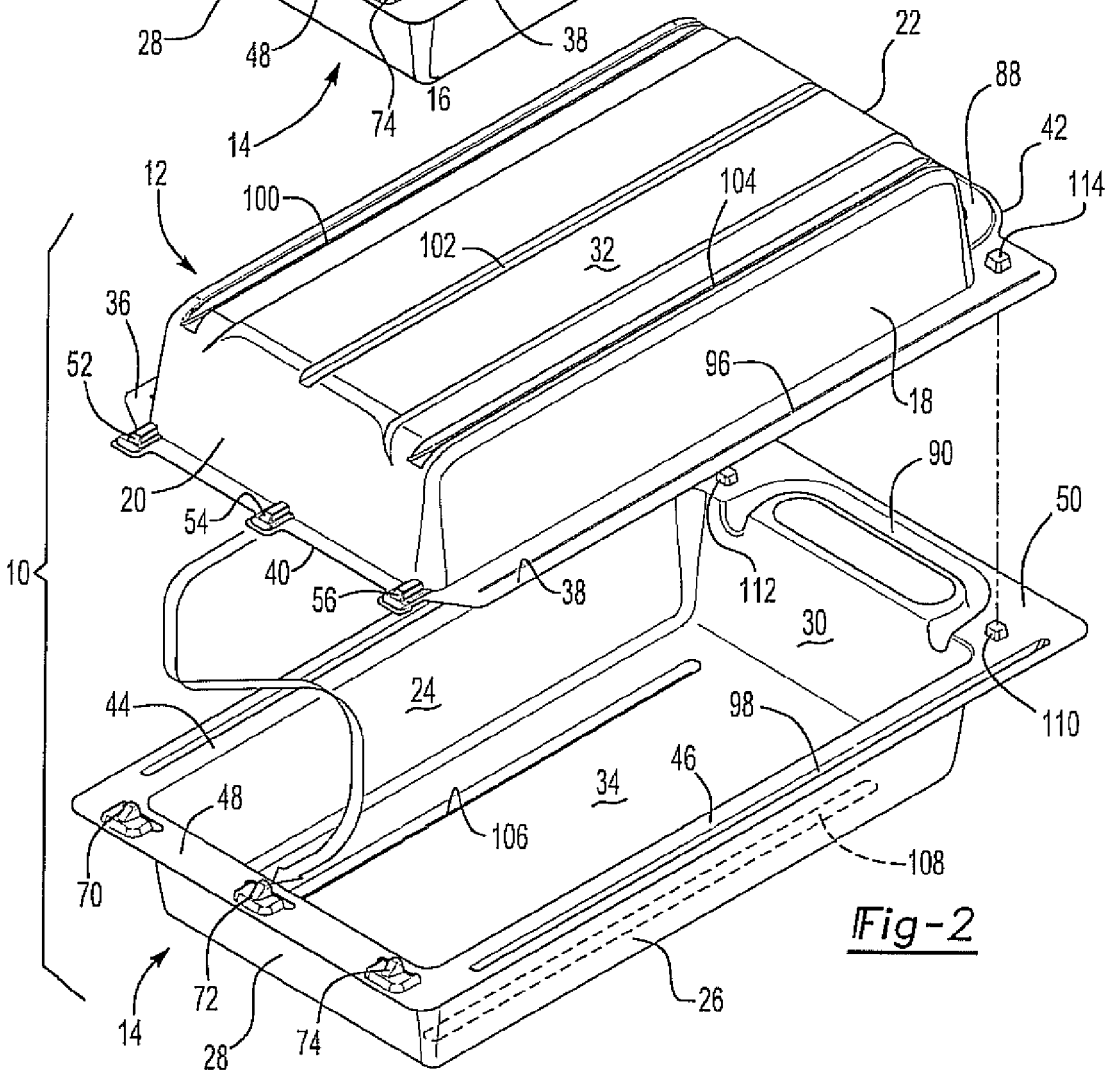
FIG. 2 is an exploded view of the container as shown in FIG. 1.

Referring again to FIG. 1 in combination with the exploded view of the container as shown in FIG. 2, the container includes a lid 12 and a base 14. Each of the lid and base are, in one variant, constructed of a plasticized material produced from such as a vacuum forming or, potentially, an injection molding process.

In a preferred embodiment, each of the lid and base exhibit a rectangular configuration (although it is contemplated that any suitable and polygonal shaped article is contemplated) with four interconnecting sides and ends which bound a recessed and volume defining interior. In particular, the lid 12 includes sides 16 and 18 and interconnecting ends 20 and 22. Concurrently, the base 14 includes sides 24 and 26 and interconnecting ends 28 and 30.

The lid 12 further includes a recessed interior surface 32 and the base 14 likewise includes a corresponding surface 34. Each of the sides and ends of the lid 12 further include outer perimeter defining and flattened edges, these being referenced at 36, 38, 40 and 42. The sides and ends of the base 14 concurrently include outer perimeter defining and flattened edges, as respectively shown at 44, 46, 48 and 50, these opposing the corresponding edges 36-42 of the lid in the closed and slid/snap shut configuration as will be subsequently described.

The lid 12 further includes a plurality of extending lips, such as shown by end defined and spaced apart lips 52, 54, 56, et seq. (see again FIGS. 1 and 2). It is further understood that any plurality of lips can be employed ranging from two upwards, and in order to achieve the desired upward support and snap shut positions of the lid.

Figure 6:
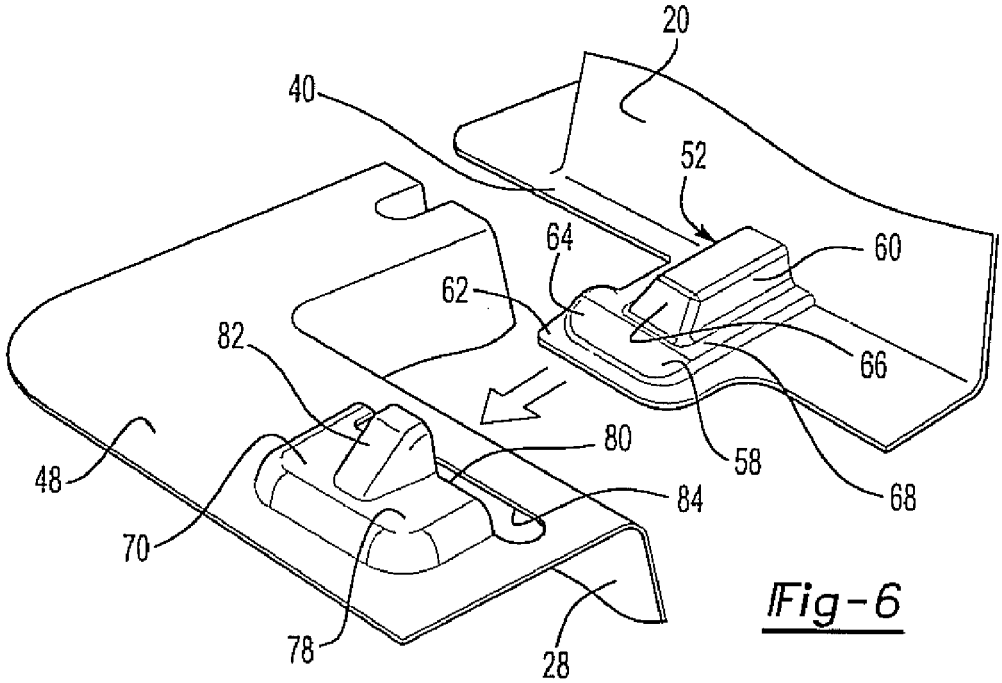
FIG. 6 is a partial perspective view illustrating, in exploded fashion, an interengagement of a hinged connection established by a lid and a base in the closed position.

As best shown in FIG. 6, illustrating in partial perspective and exploded fashion, is an interengagement of a hinged connection established by a lid and a base in the closed position and which in particular illustrates additional features of selected lip 52 including an angled ramp portion 58 and upon which is situated an integrally formed superstructure 60. The ramp portion 58 further includes a bottommost and substantially planar shaped layer 62 and an intermediate layer 64 exhibiting a progressively inwardly/downwardly angled layer formed upon the planar shaped layer 62 and in a direction away from the superstructure 60.

The configuration illustrated in the partial illustration of FIG. 6 is understood to apply to each of the other corresponding and spaced apart lips, a repetitive description of each being avoided for purposes of simplicity in the present description. As again referenced in FIG. 6, the lip support superstructure 60 further includes, as shown, a top, sides, and a downwardly/outwardly flared front (see in particular at 66) terminating in a top surface 68 of the intermediate layer 64.

Referring again to FIGS. 2 and 6, the base 14 exhibits a like plurality hinge supports, see at 70, 72, 74, et seq., each being interengageable with an associated lip 52, 54, 56. Referencing the selected hinge support 70 referenced in the enlarged partial view of FIG. 6, each further includes an inwardly facing perimeter edge (hidden from view in FIG. 6 but referenced at 76 in each of FIGS. 7 and 8) defined in the corresponding flattened end edge 48, this defining an aperture at that location.

Additional features corresponding to each of the hinge supports include a primary embossment 78 substantially overlaying the aperture 76 and including sloping edges connecting to the aperture defining perimeter in the flattened edge 48, this further revealing an open and communicable edge 80 opposing and seating a selected lip. A secondary and angular embossment 82 projects upwardly from a location of the primary embossment 78 and seats a selected superstructure, e.g. that shown again at 60 for selected lip extending portion 52, and in either the upwardly hinge supported or translated (snap-shut) configurations established between the lid 12 and base 14.

Figure 7:
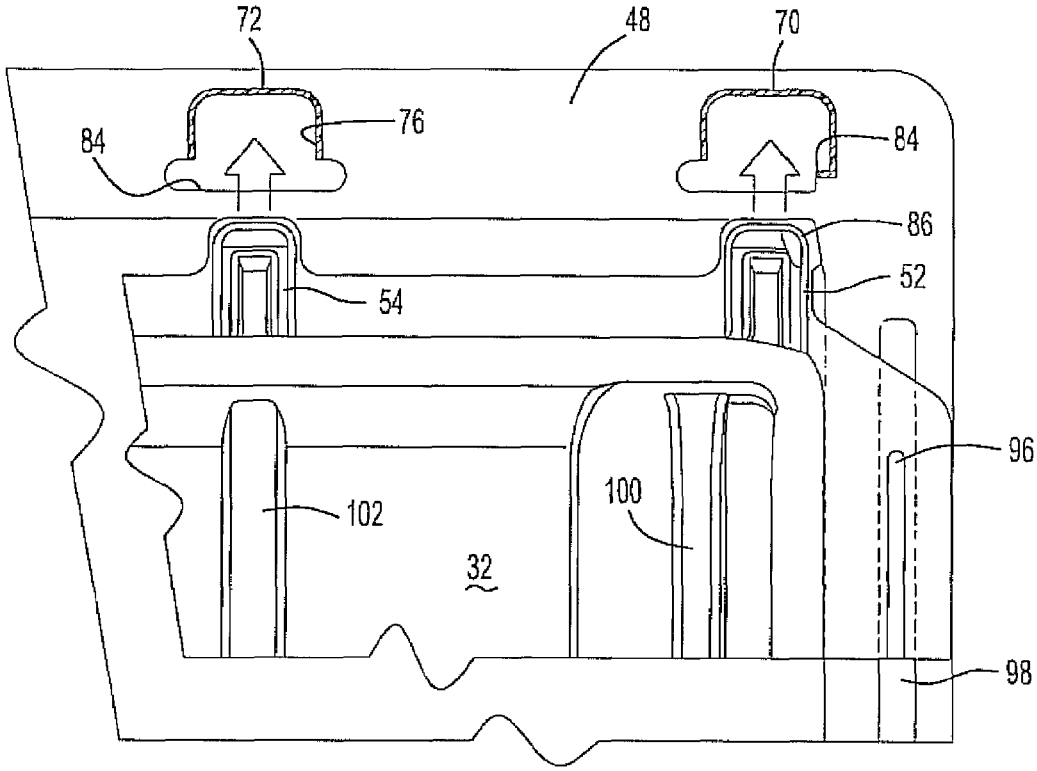
FIG. 7 is a partial top plan view of a hinged portion associated with a lid and base in a laterally separated and pre-closing position.

Referring again to the several illustrations, including FIG. 6, the perimeter defined aperture 76 has a selected shape and size and defines a further widthwise projecting portion (see as shown by slot shaped portion defined by inner communicating edge 84 in FIG. 6), this extending beyond the primary embossment 78 and contiguous with the open edge. A pair of lateral-most positioned primary embossments, see as best represented in FIG. 7 at 84 for selected hinge support 70, correspond to one corner edge location of the base end 48, each further including a lengthened outermost edge, see at 84. An associated planar shaped layer of an inserting lip edge, see as represented in each of FIGS. 7 and 8 at 86, includes a lateral tab seating within the lengthened edge 84 in the closed and linearly displaced position (see again in particular FIG. 8).

FIG. 3 illustrates a top plan view of the assembled lid 12 and base and in particular showing a handle subset portion, see at 88 and 90 for lid 12 and base 14, respectively, associated with further selected opposite end edges, see at 42 and 50, opposite those associated with the interengageable lip 52, 54, 56 and hinge 70, 72 and 74 supports, the subset portions mating upon rotating the lid to the closed position and in order to collectively define a carrying handle. Referencing further FIG. 4, a cutaway view taken along line 4-4 of FIG. 3 is shown which illustrates the respective points of engagement established between a first handle supporting end and a second hinged end.

Figure 5:
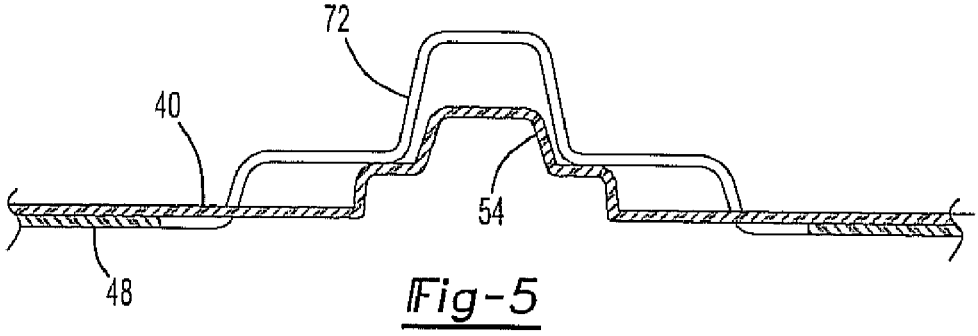
FIG. 5 is a cutaway view taken along line 5-5 of FIG. 4 and showing biasing engagement of a selected hinge location according to the present invention.
Figure 8:
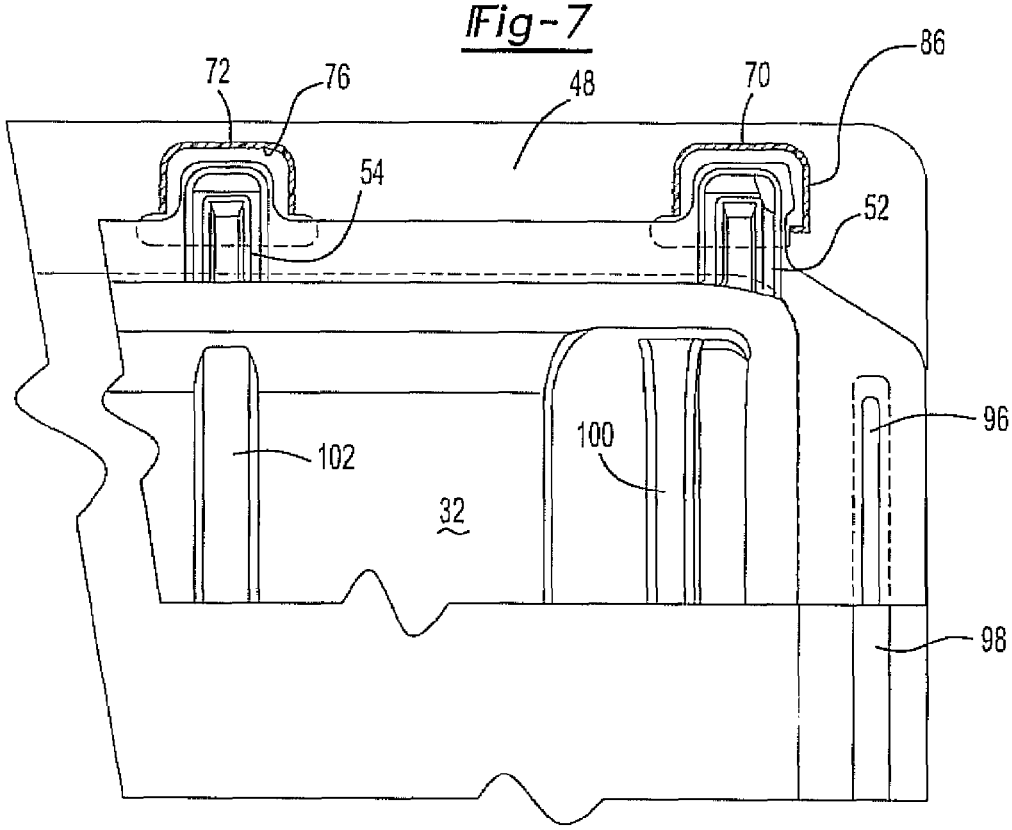
FIG. 8 is a succeeding view to that shown in FIG. 7 and illustrating the lid in a laterally translated, closed and locked position relative to the base.

FIG. 5 illustrates a cutaway view taken along line 5-5 of FIG. 4 and showing a biasing engagement of a selected hinge location, established between lip 54 and hinge support 72, according to the present invention. In particular the seating arrangement is referenced in end cutaway and which is established between the inner surface of the primary hinge support embossment and the intermediate ramp layer of the corresponding and inserted lip. The illustration of FIG. 5, in cooperation with what is shown in the partial view of FIG. 8, illustrate the tactile and snap-shut fashion of the lid relative to the base in the overall illustration of FIG. 1.

Figure 9:
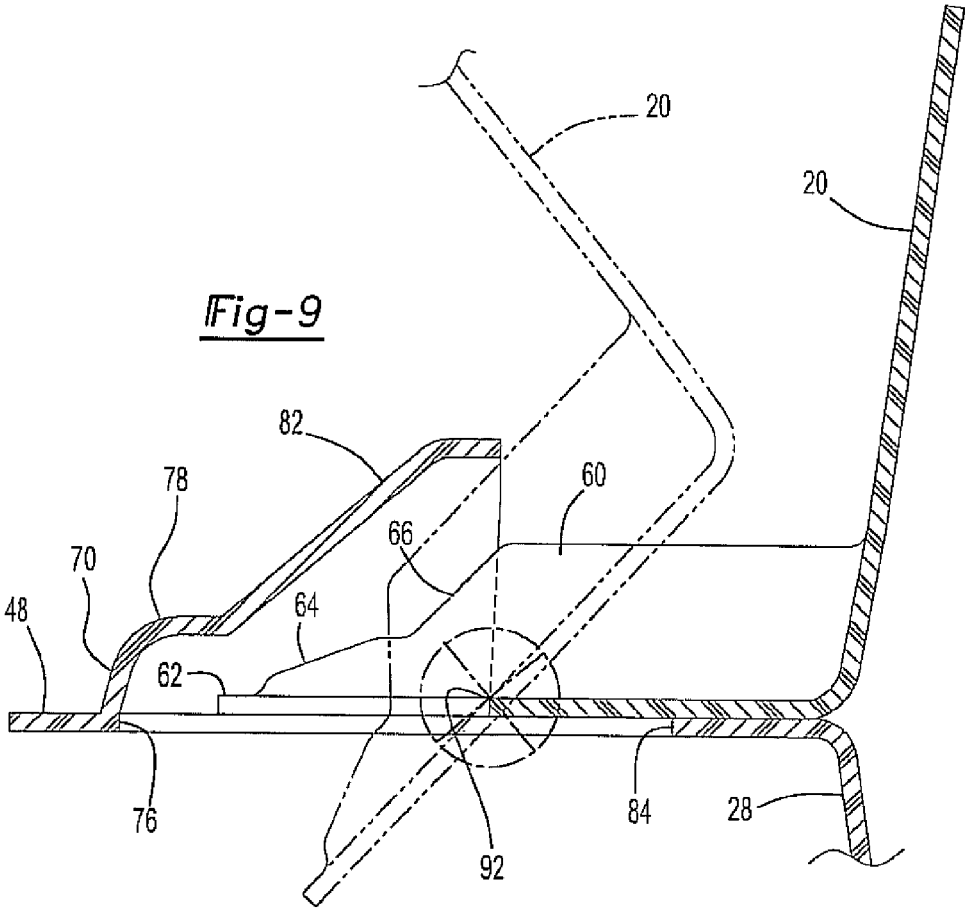
FIG. 9 is a lineal cutaway view of a selected hinged arrangement established between a lid and base and illustrating a first centerline position of a lid inserting lip portion relative to a base receiving location and during upward rotation of the lid.
Figure 10:
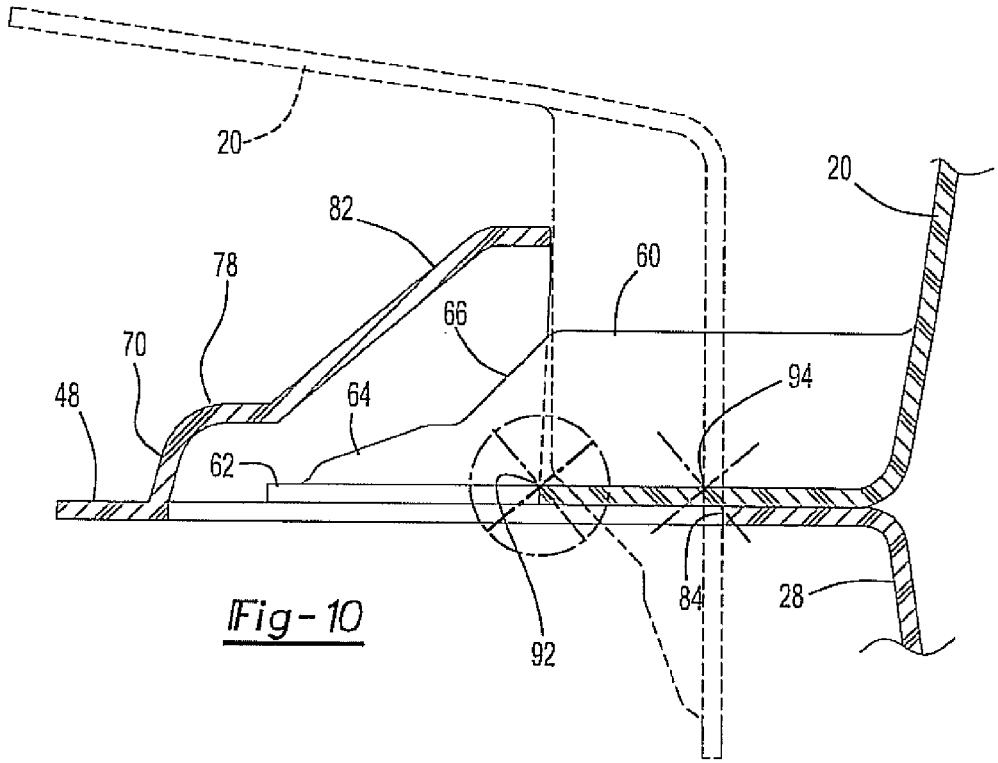
FIG. 10 is a succeeding lineal cutaway view illustrating the rearward displacement of the inserting lip centerline upon fully upward rotation of the lid to a stationary and supported upright position.

FIG. 9 is a lineal cutaway view of a selected hinged arrangement established between a lid and base, such as lip 52 and associated hinge 70 described in FIG. 6, and illustrating a first centerline position 92 of the lid inserting lip portion relative to the base receiving location, and such as during upward rotation of the lid. FIG. 10 is a succeeding lineal cutaway view illustrating the rearward displacement of the inserting lip centerline, to location 94 upon fully upward rotation of the lid to a stationary and supported upright position. In this fashion, the lid 12 is maintained in the upright supported position relative to the base 14 and across a centerline established in crosswise extending fashion proximate the edge 48 of the base 14.

Figure 11:
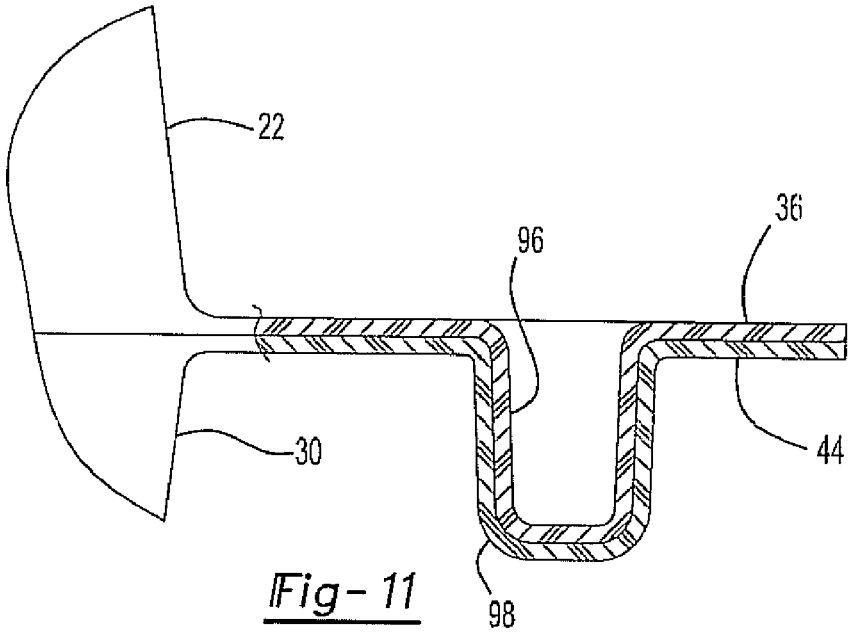
FIG. 11 is a further cutaway view taken along line 11-11 of FIG. 3 and illustrating the lengthwise extending and mating grooves established between the lid and base.

FIG. 11 is a further cutaway view, taken along line 11-11 of FIG. 3, and illustrating a lengthwise extending arrangement of mating grooves 96 and 98 established between the side edges, see for example at 36 and 44, established between the lid 12 and base 14. The grooves 96 and 98 can include either "U" shaped, "V" shaped or other cross-sectionally shaped mating grooves, these further defining lengthwise extending rails or recesses and which establish lengthwise extending and slidably interengaging portions associated with opposing and parallel disposed side edges of the base 14 and lid 12 and in order to facilitating sliding motion of the lid relative to the base, such as during locking thereto.

As best further illustrated in each of FIGS. 1 and 2, one or more lengthwise extending and recessed exterior surfaces, see at 100, 102, 104, et seq., are associated with the interior 32 of the lid and which constitute a plurality of parallel, spaced apart and lengthwise interengaging portions between individual container assemblies. Corresponding lengthwise extending and recessed exterior surfaces, see at 106 and in phantom at 108 in FIG. 2, are associated with the recessed base surface 34, these further typically being provided as a pair of outermost and lengthwise interengaging portions which are selectively seatable within selected ones of the recessed lid surfaces 100, 102, 104, further such that a lid of a first selected container may support thereupon a base of a second selected container.

An additional feature illustrated in the exploded view of FIG. 2, is a first pair of substantially circular and ramped embossments 110 and 112 projecting from edge surfaces of the base 14, at locations along edge surface 50 and proximate its associated subset handle portion 90. A second pair of substantially circular shaped recesses project from an opposing edge surface 42 of the lid 12 (only a first of which is shown at 114, the second being hidden from view) and proximate its associated subset handle portion 90, further such that the circular recesses seat within the opposing circular base embossments in the closed position. The circular embossments 110 and 112 and corresponding recesses (e.g. at 114) may be reversed in arrangement, and further are typically angled or tapered to assist in establishing the tactile snap shut arrangement of the lid when translated to the position shown in FIG. 1.

Having now described my invention, other and additional preferred embodiments will become apparent to those skilled in the art to which it pertains, and without deviating from the scope of the appended claims.

I claim:

1. A two piece storage container, comprising:

a multi-sided lid including a plurality of lips extending in a combined linear and upwardly projecting fashion from a selected edge of said lid;

a multi-sided base corresponding generally in outline with said lid, said base including a plurality of upwardly projecting hinge supports, said hinge supports each exhibiting an inwardly facing perimeter defining an aperture which is located proximate a selected planar edge of said base and within which seats an associated lip in opposing and communicable fashion upon positioning of said lid over said base and linearly inserting said lips within said inwardly facing hinge support apertures;

each of said lid and base defining a substantially rectangular shaped body with four interconnecting side edges bounding recessed interiors, lengthwise extending and slidably interengaging portions being associated with opposing and parallel disposed side edges of said base and lid; and said lips being angularly supported within said hinge supports in a first open rotated position, upon rotating said lid to a closed position said lips capable of being linearly displaced against said hinge supports to lock said lid to said base.

2. The container as described in claim 1, each of said lid and base further comprising a handle subset portion associated with further selected edges opposite those associated with said lips and hinge supports, said subset portions mating upon rotating said lid to the closed position to define a carrying handle.

3. The container as described in claim 1, each of said lid and base exhibiting a selected shape and size and further comprising a plasticized material produced from at least one of a vacuum forming or injection molding process.

4. The container as described in claim 1, each of said lips father comprising an angled ramp portion upon which is situated an integrally formed superstructure.

5. The container as described in claim 4, said ramp portion further comprising a bottommost and substantially planar shaped layer, an intermediate layer exhibiting a progressively inwardly/downwardly angled layer formed upon said planar shaped layer and in a direction away from said superstructure.

6. The container as described in claim 1, a lengthwise extending and recessed exterior surface associated with said lid further comprising a plurality of parallel, spaced apart and lengthwise interengaging portions, a corresponding lengthwise extending and recessed exterior surface associated with said base further comprising at least a pair of outermost and lengthwise interengaging portions which are selectively seatable within selected ones of said recessed lid surface portions such that a lid of a first selected container may support thereupon a base of a second selected container.

7. The container as described in claim 2, a first pair of substantially circular and ramped embossments projecting from edge surfaces of said base proximate said associated subset handle portion, a second pair of substantially circular shaped recesses projecting from opposing edge surfaces of said lid proximate its associated subset handle portion and seating within said circular base embossments in said closed position.

8. A two piece storage container, comprising:

a lid having a substantially rectangular shape with sides and ends defining therebetween a recessed interior, said lid including a plurality of spaced apart lips extending from a selected end, each of said lips extending in a combined linear and upwardly projecting fashion from said lid, each of said lips further comprising an angled ramp portion upon which is situated an integrally formed superstructure;

a base corresponding generally in outline with said lid and including a plurality of upwardly projecting hinge supports which are located proximate to an associated end of said base arrayed in opposing and communicable fashion relative to said lips upon positioning of said lid over said base, each of said hinge supports exhibiting an inwardly facing perimeter defining an aperture associated with an associated and linearly inserting lip; and said spaced apart lips being angularly supported within said hinge supports in a first open rotated position, upon rotating said lid to a closed position said lips linearly displacing against said hinge supports such that each of said angled ramp portions engages a corresponding hinge support to lock said lid to said base in a tactile and snap-shut fashion.

9. The container as described in claim 8, each of said lid and base further comprising a handle subset portion associated with further selected edges opposite those associated with said lips and hinge supports, said subset portions mating upon rotating said lid to the closed position to define a carrying handle.

10. A two piece storage container, comprising:

a multi-sided lid including at least one lip extending from a selected edge of said lid, said lid exhibiting a specified shape and size and having a plurality of extending lips, each further comprising an angled ramp portion upon which is situated an integrally formed superstructure;

said ramp portion further comprising a bottommost and substantially planar shaped layer, an intermediate layer exhibiting a progressively angled layer formed upon said planar shaped layer and in a direction away from said superstructure, each of said lips further comprising a top, sides, and a flared front terminating in a top surface of said intermediate layer;

a multi-sided base corresponding generally in outline with said lid, said base including at least one upwardly projecting hinge support which is located proximate a selected edge of said base and in opposing and communicable fashion relative to said lid upon positioning of said lid over said base; and each of said lips being angularly supported within a selected hinge support in a first open rotated position, upon rotating said lid to a closed position said lips being linearly displaced against a hinge support, such that each of said angled ramp portions engages a corresponding hinge support to lock said lid to said base in a tactile and snap-shut fashion.

11. The container as described in claim 10, said base exhibiting a specified shape and size and having a plurality hinge supports equal to and interengageable with said lips, each of said hinge supports further comprising:

an inwardly facing perimeter in said base defining an aperture;

a primary embossment substantially overlaying said aperture and revealing an open edge opposing and seating a selected lip; and a secondary and angular embossment projecting upwardly from a location of said primary embossment and seating a selected superstructure.

12. The container as described in claim 11, said aperture having a selected shape and size and defining a widthwise projecting portion extending beyond said primary embossment contiguous with said open edge.

13. The container as described in claim 12, a pair of lateralmost positioned primary embossments each further comprising a lengthened outermost edge, an associated planar shaped layer of an inserting lip edge further comprising a lateral tab seating within said lengthened edge in said closed and linearly displaced position.

14. A two piece storage container, comprising:

a multi-sided lid including a plurality of lips extending from a selected edge of said lid, each of said lips further comprising an angled ramp portion upon which is situated an integrally formed superstructure;

said ramp portion further comprising a bottommost and substantially planar shaped layer, an intermediate layer exhibiting a progressively angled layer formed upon said planar shaped layer and in a direction away from said superstructure, said superstructure further comprising a top, sides, and a flared front terminating in a top surface of said intermediate layer;

a multi-sided base corresponding generally in outline with said lid, said base including a plurality of upwardly projecting hinge supports located proximate a selected edge of said base and in opposing and communicable fashion relative to said lid upon positioning of said lid over said base; and said lips being angularly supported within said hinge supports in a first open rotated position, upon rotating said lid to a closed position said lips capable of being linearly displaced against said hinge supports such that each of said angled ramp portions engages a corresponding hinge support to lock said lid to said base in a tactile and snap-shut fashion.

15. The container as described in claim 14, said base exhibiting a specified shape and size and having a like plurality hinge supports interengageable with said lips, each of said hinge supports further comprising:

an inwardly facing perimeter in said base defining an aperture;

a primary embossment substantially overlaying said aperture and revealing an open edge opposing and seating a selected lip; and a secondary and angular embossment projecting upwardly from a location of said primary embossment and seating a selected superstructure.

16. The container as described in claim 15, said aperture having a selected shape and size and defining a widthwise projecting portion extending beyond said primary embossment contiguous with said open edge.

17. The container as described in claim 16, a pair of lateralmost positioned primary embossments each further comprising a lengthened outermost edge, an associated planar shaped layer of an inserting lip edge further comprising a lateral tab seating within said lengthened edge in said closed and linearly displaced position.

* * * * *